United States Patent [19]

Nuerk

[11] Patent Number: 4,827,090

[45] Date of Patent: May 2, 1989

[54] DEVICE FOR MONITORING YARN RESERVE ON YARN SPOOLS

[76] Inventor: Siegfried Nuerk, Bolstrasse 23/1, 7470 Albstadt 17-Pfeffingen, Fed. Rep. of Germany

[21] Appl. No.: 142,718

[22] Filed: Jan. 11, 1988

[30] Foreign Application Priority Data

Jan. 24, 1987 [DE] Fed. Rep. of Germany ..... 3702049

[51] Int. Cl.[4] ..... B65H 49/02

[52] U.S. Cl. ..... 200/61.15; 242/36; 242/130; 340/677

[58] Field of Search ..... 200/61.18, 61.13, 61.14, 200/61.15, 61.16, 61.17; 340/674, 675, 676, 677; 242/36, 130, 131

[56] References Cited

U.S. PATENT DOCUMENTS 2,507,078 5/1950 Wright ..... 200/61.15

*Primary Examiner*—A. D. Pellinen
*Assistant Examiner*—Morris Ginsburg

[57] ABSTRACT

A device for monitoring a yarn reserve on a stationary yarn spool from which the yarn is being pulled off, including a feeler applied to the end face of the yarn package and coupled to a swinging switching arm which cooperates with a switch. The feeler can perform a movement along the external surface of the spool and bring the switching arm to the position in which the switch is actuated. A locking lever is provided in the device which can lock the switching arm in the end position.

13 Claims, 3 Drawing Sheets

DEVICE FOR MONITORING YARN RESERVE ON YARN SPOOLS

BACKGROUND OF THE INVENTION

The present invention relates to a device for monitoring a yarn reserve on a yarn spool from which the yarn is pulled off over a head.

Monitoring devices of the type under consideration include a feeler which is spring-biased and applied to a yarn package on the spool.

Textile machines which operate with yarn must be switched off when the yarn reserve on the spool is exhausted and the yarn end of this spool has not yet been connected with the yarn end of a new full spool. The spool holders with operating spools and reserve spools become obstructed and can not be employed at all places. Furthermore, the pull-off transition to the reserve spool with badly reeled spools would result in an additional source of disturbance.

However, to wait till the yarn would be completely pulled off the spool before the machine is switched off by a so-called thread watcher has been disadvantageous because it has been very difficult and troublesome to tie up the starting point of the yarn of the next yarn spool with the end of the yarn being pulled off the previous spool. With badly wound spools, there is the danger that in the last layers the remaining yarn turns would slide down and form a thread clew.

Devices have been proposed by means of which the start of pulling off the last yarn layer from the spool can be determined. With these conventional devices the end region of the body of the spool at the side opposite to that at which the yarn is pulled off, has been provided with at least one opening through which a feeler of the switching device has been applied to the innermost yarn layer; the feeler has performed a switching movement as soon as the yarn of the last thread layer on the spool has been removed at the place of sensing. These known devices, however have the disadvantage that specific yarn spools provided with openings for feelers have been required, and the yarn spool body must always cooperate with the switching device.

It has been also known to optically scan the yarn spools on their external sides and provide the surfaces to be wound upon with thread with a reflecting coating so that after removing the last wound yarn layer from the spool light reflection is obtained at the place of scanning, which can be utilized as a control signal for the switching off the textile machine. This monitoring device however has the disadvantage which resides in that this device can be utilized only in connection with specially prepared spools also provided with reflecting surfaces, and the application of such a device can cause sometimes false switchings of the machine due to light reflection when gloss yarns are used.

SUMMARY OF THE INVENTION

It is an object of the present invention to provide an improved device for monitoring yarn reserve on yarn spools.

It is another object of the invention to provide a monitoring device which would be efficient for various types of yarn spools independently from their constructions and the position of the wound package on the spool and the nature of the yarn on the spool.

It is a further object of the invention to provide a monitoring device which would efficiently operate also independently from the condition of the upper face of the yarn spool.

These and other objects of the invention are attained by a device for monitoring a yarn reserve on a yarn spool from which a yarn is pulled off over a head, comprising a feeler which is spring-biased and applied to a yarn package on said spool, spring means for pre-stressing said feeler against an end face of the yarn package which faces away from a side of pulling off the yarn from the spool, and means for applying said feeler to said end face under pre-stressing by said spring means and moving said feeler relative to said end face.

The means for applying the feeler to the yarn spool may include means for positioning said feeler additionally on a peripheral surface as a body of said spool and moving said feeler along said peripheral surface.

In contrast to conventional monitoring devices of the foregoing type, provided with mechanical yarn supply feelers, in the device of the present invention the feeler abuts against the end face of the yarn package and may be selectively released when abutting the last yarn layer or before winding off to the second innermost layer or the third innermost layer, and its switching motion along the surface of the spool can be performed.

With the device of this invention it is ensured that the feeler always carries out its switching movement as long as the remains of the yarn reserve on the spool is available, and a new start of the textile machine is possible without long interruptions.

The feeler-applying means may include a switching arm pivotally connected to said feeler and pre-stressed by said spring means, said switching arm being adapted to be locked in an initial position, and a supporting arm adapted to slide on said peripheral surface at a butt edge of said body of said spool and supporting said feeler when the latter is applied to said peripheral surface.

The supporting arm passes the butt edge of the yarn spool and moves along with the feeler on the peripheral surface of the spool body.

The device of this invention can be applied to yarn spools with spool bodies of different size and different thickness, usually to sleeve-shaped yarn spools. It is ensured that the feeler always comes into contact with the end face of the yarn package.

The feeler-applying means may further include a locking lever which has a releasing arm which is in contact with said butt edge when said feeler is applied to said peripheral surface, at least said switching arm and said feeler in said initial position being in engagement with said locking lever.

The switching arm may be formed as a swinging arm having a swinging end, said feeler having a tip and a free end pivoted at a pivot joint on said swinging end of said switching arm, said tip in a locked position of said switching arm lying on said supporting arm.

With the switching arm formed as a double-arm swinging or rocking element a space-favorable arrangement of the feeler relative to a relatively long switching path is possible. The monitoring devices should be applicable not only to the yarn spools of different dimensions but also they should be positioned at various distances from the end face of the yarn spool body. The device of this invention can be also used for releasing the feeler that has been locked.

In a further modification, the supporting arm may be a double-arm swinging element, one arm of which forms a portion which is adapted to slide on said peripheral surface and another arm of which is provided with a stop acting on said switching arm in a return direction, and wherein a spring is provided which acts on said another arm and exerts on said supporting arm a torque which is greater than a counter torque exerted on said switching arm and said feeler by said spring means.

The portion of the supporting arm and said releasing arm of said locking lever may be positioned in said locked position at the same level in a direction towards said spool. The advantage of such structure resides in that the yarn spool can slide on the spool supporting rod while the monitoring device will not be actuated. The monitoring device is first actuated when the end of the body of the yarn spool presses against the releasing arm of the locking lever whereby the portion of the supporting arm which lies at the same level slides along the external or peripheral surface of the body of the yarn spool before the releasing arm of the locking lever is engaged. Then the spool displaces the releasing arm and the switching arm with the feeler are released and the feeler comes into contact with the end face of the yarn package. If the yarn spool is again detached the device returns to its locked and initial position.

The applying means may further include a permanent magnet provided on said switching arm, and a reed switch is magnetically influenced by said permanent magnet, said magnet being positioned in a maximally pivoted position of said switching arm towards said butt edge in the proximity of said switch to switch on the latter.

The device may include a housing which accommodates said feeler, said spring means and said appyling means, said housing means having an opening for passing therethrough said feeler, said supporting arm and said releasing arm of said locking lever.

The housing may have a clamping abutment or a receiving opening for positioning the device on a spool holding rod and connecting the device to said rod.

The aforementioned switch may be a reed-contact switch or a Hall generator, accommodated in the housing of the monitoring device.

The invention, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
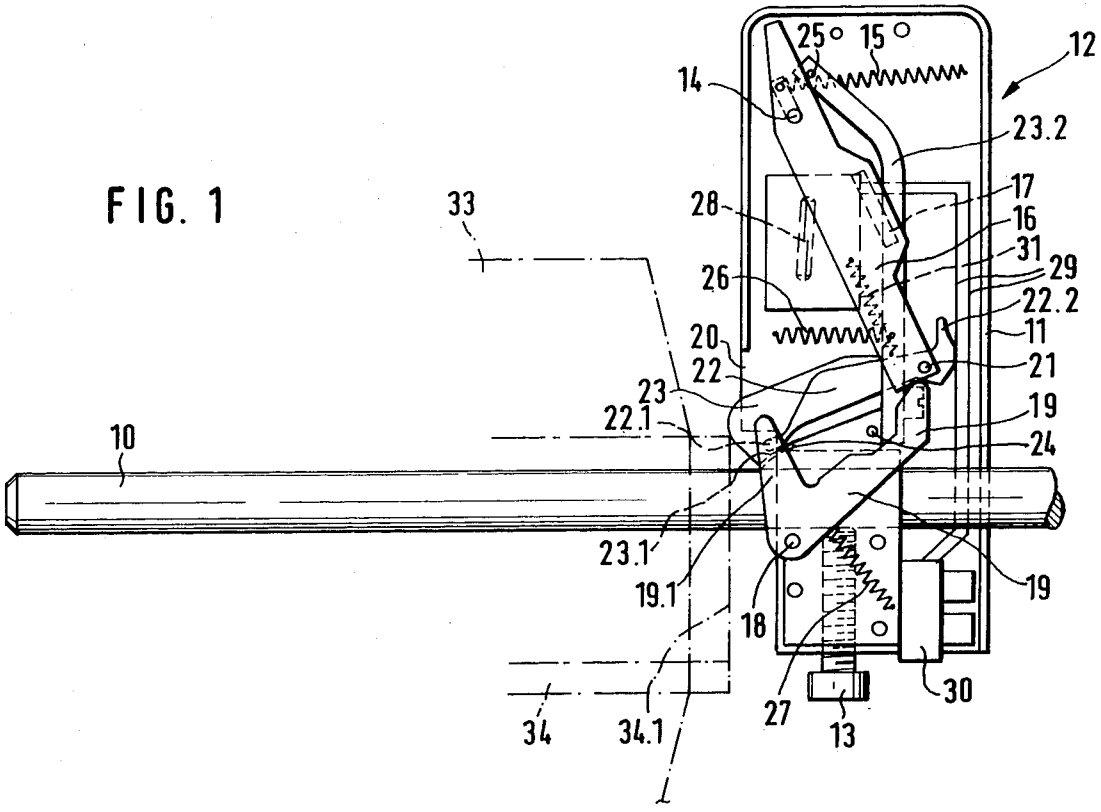
FIG. 1 is a side view of the monitoring device arranged on a spool retaining rod, in its initial locked position.

Referring now to the drawings in detail, it will be seen that a spool retaining rod of a spool creel for a knitting machine is designated by reference numeral 10. The spool retaining rod 10 is shown in this example in the horizontal position. It can also have a usual inclined position or can be formed as a vertical spool mounting pin. A housing 11 of a square cross-section is provided with a passage for receiving the spool retaining rod 10 and is connected to the rod by means of a clamping bolt 13. A spool body 34, together with a yarn package 33 is held in a stationary position on the retaining rod 10 by the force of gravity. In the shown example, one wall of the housing 11 of the monitoring device 12 is removed to make the interior of the monitoring device visible.

The important part of the monitoring device is a switching arm 16 which is pivotable about an axle 14 and is pre-stressed by a tension spring 15 secured to the housing 11. Switching arm 16 carries in the middle region of its rear side a rod-shaped permanent magnet 17. The switching arm 16 at its front end engages, as shown in FIG. 1, a locking lever 19 which is pivotable about a pivot axle 18. Locking lever 19 has in the region of a housing opening 20, a releasing arm 19.1. A feeler 22 formed as a rocking lever is supported in a bearing 21 mounted on the rear side of the front end of the switching arm 16. Feeler 22 extends parallel to a supporting arm 23 which in FIG. 1 is shown behind the feeler 22. A feeler tip 22.1 is supported in the locked position of the monitoring device, illustrated in FIG. 1, against the supporting arm, namely against the lateral stop portion 23.1 thereof. The supporting arm 23 is pivotally mounted on a pivot axle 24 secured to housing 11 and has an elongated counter arm 23.2 which is provided with an abutment or stop 25 for engaging the switching arm 16.

The switching arm 16, locking lever 19, feeler 22 and supporting arm 23 lie in parallel planes of which the uppermost plane is the plane of the switching arm 16 and locking lever 19, the second or intermediate plane is that of the feeler 22 and the third plane is that of the supporting arm 23. The counter arm 23.2 of arm 23 is prestressed by a tension spring 26 secured to housing 11. The latter exerts on the supporting arm 23 a torque which is greater than the torque which the spring 15 exerts on the switching arm 15 in the opposite direction.

The locking lever 19 is acted upon by a compression spring 27 secured to the housing 11. The feeler 22 is pre-stressed by a compression spring 31 anchored to the switching arm 16. The pivoting range of the feeler 22 is limited by a stop nose or projection 22.2. The switching arm 16 cooperates with a reed-contact switch 28 which is positioned inside the housing 11 and is connected via electric lines 29 with a socket-plug box 30.

FIG. 1 illustrates the monitoring device 12 in its locked position in which the switching arm 16 is held in its initial position by the locking lever 19 engaging its front end and at its rear end by the stop 25 of the counter arm 23.2 of the supporting arm 23. In this initial or starting position of the switching arm, the feeler 22 is pulled back into the opening 20 of the housing 11 and its tip 22.1 is supported against the stop portion 23.1 of the supporting arm 23. In the locked position of the monitoring device, the releasing arm 19.1 of the locking lever 19 and the lateral stop portion 23.1 of the supporting arm 23 are positioned in the opening 20 of housing 11 and the monitoring device is non-operative. It can be also maintained in this position with the creeled yarn spool but non-pressed yarn spool body.

A yarn package 33 and a cylindrical yarn spool body 34 are shown in FIG. 1 by dash-dotted lines. Yarn spool body 34 can be displaced on the spool retaining rod 10 as a reserve spool only until the spool body edge 34.1 comes into contact with the head of the supporting arm 23, which forms an inclined slide surface. The monitoring device is actuated when the end 34.1 of the spool body 34 contacts the head of the supporting arm 23 and then is pressed against the releasing arm 19.1 of the locking lever 19 as shown in FIG. 2.

Figure 2:
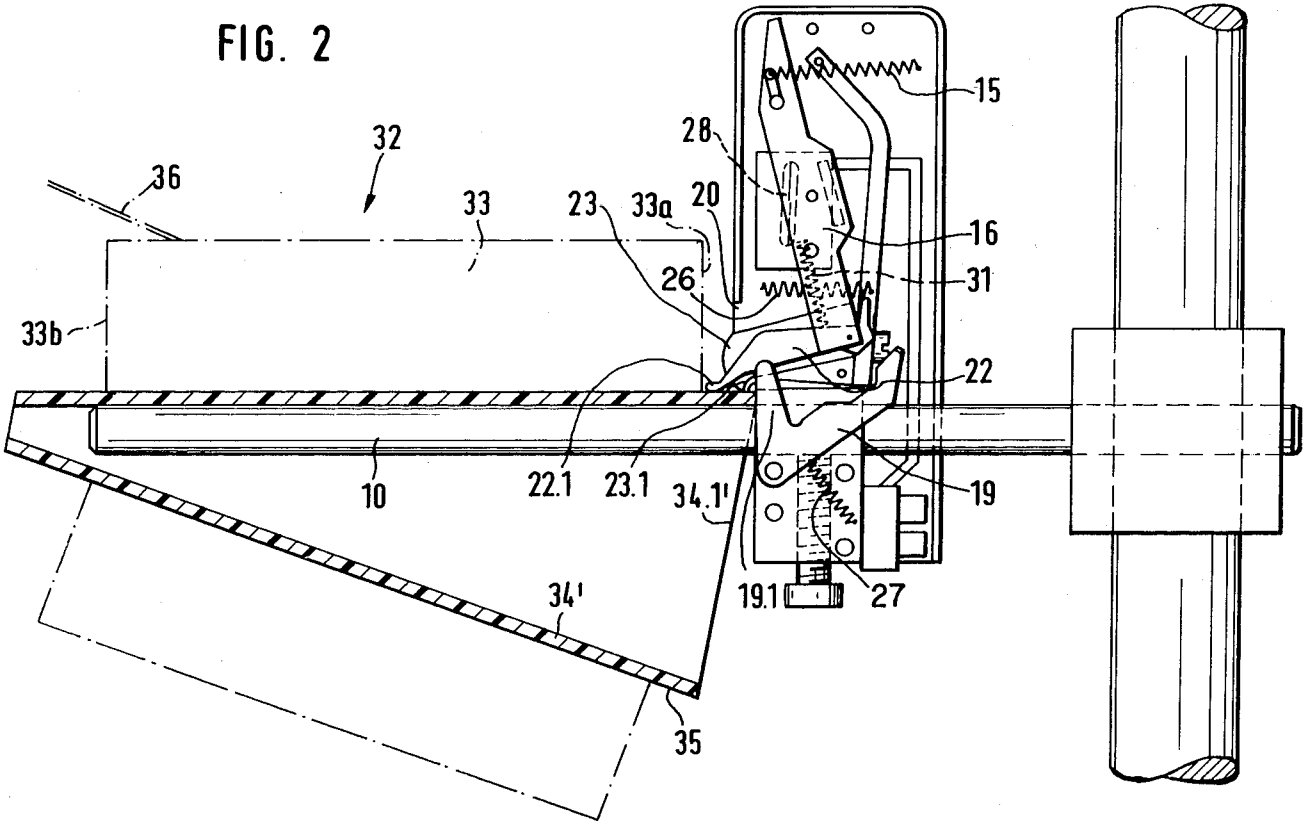
FIG. 2 is a side view of the monitoring device of FIG. 1 in its operative position in contact with a reeled yarn spool.

FIG. 2 illustrates a conical yarn spool 32, a conical body 34' of which is displaceable on the spool retaining rod 10. The body of the yarn spool 32 has a butt edge 34.1' which is moved into the housing opening 20 until the supporting arm 23 which pivots against the force of spring 26 in the clockwise direction until its stop portion 23.1 lies on the free end of the outer surface 35 of the spool. The locking lever 19 due to the pressure of the butt edge 34.1' of the spool against amr 19.1, is also pivoted in the clockwise direction and thus releases the switching arm 16. When released the switching arm 16 is pivoted under the action of tension spring 15 in the clockwise direction until the tip 22.1 of the feeler 22 abutts against the end face 33*a* of the spool package 33 of yarn spool 32. At the same time, the feeler tip 22.1, on which the compression spring 31 acts, is held against the surface 35 of the spool body 34'. The yarn 36 which forms the spool package 33 is pulled off the rigidly positioned yarn spool 32 over the head of the yarn spool and also over the other end face 33*b* of the yarn package 33.

Figure 3:
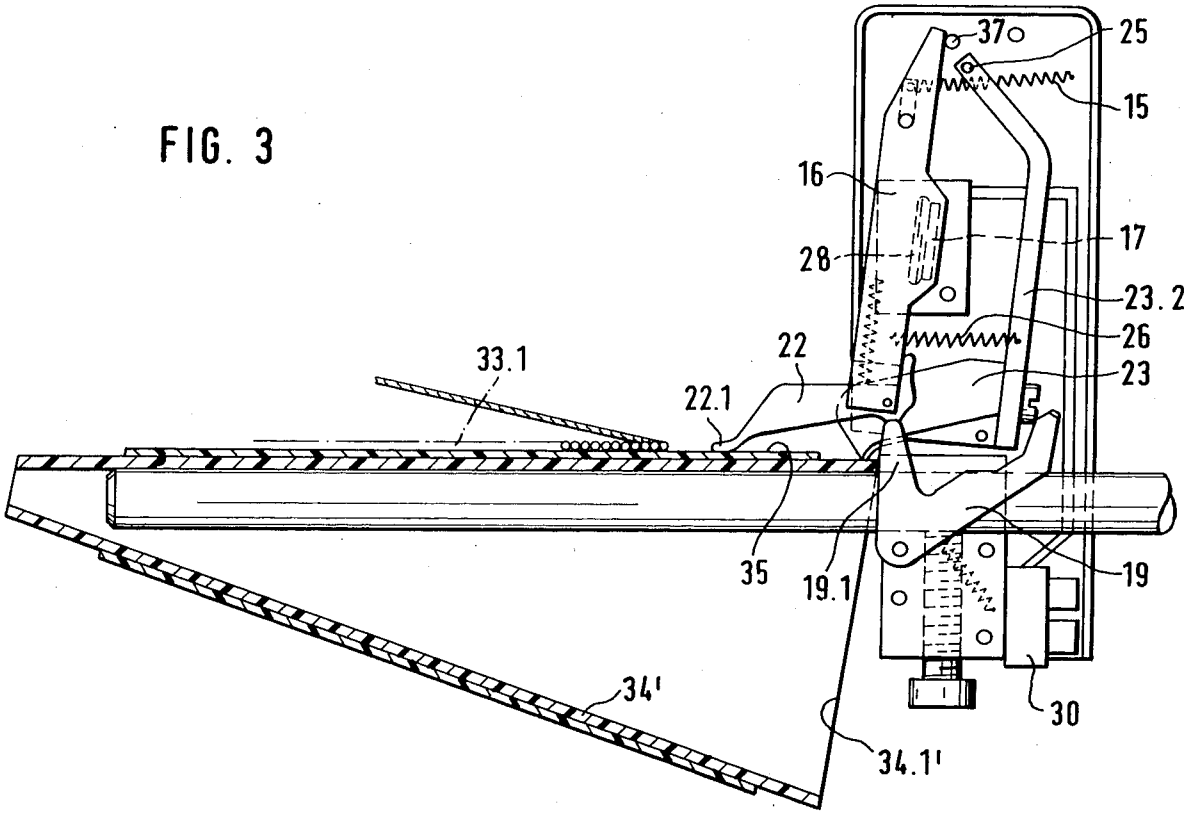
FIG. 3 is a side view of the monitoring device of FIG. 1 in its signal-issuing position with an almost emptied yarn spool.

As soon as the last yarn layer 33.1 of the yarn package 33 is pulled off the spool body, as shown in FIG. 3, the counter pressure against the tip 22.1 of the feeler 22 is ceased. Spring 15 urges the switching arm 16 to pivot further in the clockwise direction whereby this arm moves the feeler 22 along the surface of the last yarn layer 35 of the spool body 34' until the switch position is reached, limited by the housing stop 37. In this switch position, the permanent magnet 17 acts on the reed-contact switch 28 which issues the control signal which leads to switching off the textile machine and can release an optical or acoustic signal.

If the spool body 34' is removed the locking lever 19 and the supporting arm 23 are also released. The counter arm 23.2 of the supporting arm 23 is urged by tension spring 26 to pivot back in the counter-clockwise direction and take along with the stop 25 the switching arm 16 against the force of the tension spring 15 until the locking position of FIG. 1 is reached, in which position the front end of the switching arm 16 or the feeler 22 are locked by the released locking lever 19.

The control circuit in which the switch 28 is connected, can be of any suitable conventional type. The tip 22.1 of the feeler 22 can be adjusted so as to be more or less inclined relative to the surface of the spool body. Accordingly it can be selectively applied onto the second lowermost or the third lowermost layer of the yarn package and be released already during the pulling off of these last mentioned layers. The housing 11 of the monitoring device can be provided with a non-shown indicator lamp. It can also have a common indicating plate for all yarn spool positions of the textile machine.

It will be understood that each of the elements described above, or two or more together, may also find a useful application in other types of devices for monitoring yarn spool positions on the spool retaining rods differing from the types described above.

While the invention has been illustrated and described as embodied in a device for monitoring yarn supply on a yarn spool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A device for monitoring a yarn reserve on a yarn spool from which a yarn is pulled off overhead, comprising means for retaining a yarn spool in a stationary position; a movable elongated feeler; means for locking said feeler in an initial position; means for moving said feeler from said initial position toward a spool retained in said stationary position, and said moving means including spring means for biasing said feeler in a longitudinal direction and in a radial direction relative to a spool retained in said stationary position.

2. The device as defined in claim 1 wherein said spring biased moving means include a switching arm pivotally supported at one end thereof from an initial position to swing in the longitudinal direction relative to a spool in the stationary position; said feeler being pivotably connected to the other end of said switching arm and biased by a spring to rotate in the radial direction of a spool retained in the stationary position; and locking means engaging said switching arm in said initial position of said feeler in which said feeler is held away from a spool retained in the stationary position; a supporting arm having an inclined end edge cooperating with a butt edge of a yarn spool to slide on a free end surface position thereof when the yarn spool is placed into its stationary position on said retaining means, and a lateral stop portion for supporting said feeler when said switching arm is in said initial position.

3. The device as defined in claim 2 wherein said locking means include a two-arm lever having a locking arm spring-biased into engagement with said switching arm to lock the same in said initial position, and a releasing arm cooperating with the butt edge of a yarn spool to disengage said locking arm from said switching arm and release said moving means and said feeler to move in said longitudinal and radial directions.

4. The device as defined in claim 3 wherein said switching arm supports a permanent magnet for actuating a fixedly mounted reed switch when, upon unwinding a predetermined amount of yarn from a yarn spool the feeler starts sliding along a peripheral surface portion of the yarn spool and releases the movement of said switching arm against said reed switch.

5. The device as defined in claim 1 wherein said retaining means includes a retaining rod.

6. A device for monitoring a yarn reserve on a yarn spool for supporting a yarn package from which a yarn is pulled off overhead, comprising a yarn spool; means for retaining said yarn spool in a stationary position; a feeler; spring means for pre-stressing said feeler against said spool to engage an end face of a yarn package which faces away from a side of pulling off the yarn from the spool; means for applying said feeler to said spool under pre-stressing by said spring means; said applying means including means for positioning said feeler on a peripheral surface of a body of said spool and moving said feeler along said peripheral surface; said applying means further including a switching arm pivotally connected to said feeler and pre-stressed by said spring means, said switching arm being adapted to be locked in an initial position; and a supporting arm adapted to slide on said peripheral surface at a butt edge of said body of said spool and supporting said feeler when the feeler is applied to said peripheral surface.

7. The device as defined in claim 6, wherein said applying means further include a locking lever which has a releasing arm which is in contact with said butt edge when said feeler is applied to said peripheral surface, said switching arm and said feeler in said initial position being in engagement with said locking lever.

8. The device as defined in claim 7, wherein said switching arm is formed as a swinging arm having a swinging end, said feeler having a tip and a free end pivoted at a pivot joint on said swinging end of said switching arm, said tip in a locked position of said switching arm lying on said supporting arm.

9. The device as defined in claim 8, wherein said supporting arm is a double-arm swinging element, one arm of which forms a portion which is adapted to slide on said peripheral surface and another arm of which is provided with a stop acting on said switching arm in a return direction, and wherein a spring is provided which acts on said another arm and exerts on said supporting arm a torque which is greater than a counter torque exerted on said switching arm and said feeler by said spring means.

10. The device as defined in claim 9, wherein said portion of said supporting arm and said releasing arm of said locking lever are at the same level in a direction of said butt edge.

11. The device as defined in claim 9, wherein said applying means further include a permanent magnet provided on said switching arm, and a switch magnetically influenced by said permanent magnet, said magnet being positioned in a maximally pivoted position of said switching arm towards said butt edge in the proximity of said switch to switch on the latter.

12. The device as defined in claim 11, further including housing means accommodating said feeler, said spring means and said applying means, said housing means having an opening for passing therethrough said feeler, said supporting arm and said releasing arm of said locking lever.

13. The device as defined in claim 12, wherein said housing means has a reeling opening for positioning the device on a spool holding rod.

* * * * *